US011264697B2

(12) United States Patent
Kilmer et al.

(10) Patent No.: US 11,264,697 B2
(45) Date of Patent: Mar. 1, 2022

(54) LINKED ANTENNA PAIR FOR TRANSMISSION THROUGH SHIELDED SHIPPING CONTAINER

(71) Applicant: American Aerogel Corporation, Rochester, NY (US)

(72) Inventors: Derek S. Kilmer, Pittsford, NY (US); Gary A. Kneezel, Webster, NY (US)

(73) Assignee: American Aerogel Corporation, Rochester, NY (US)

( * ) Notice: Subject to any disclaimer, the term of this patent is extended or adjusted under 35 U.S.C. 154(b) by 357 days.

(21) Appl. No.: 16/342,811

(22) PCT Filed: Oct. 17, 2017

(86) PCT No.: PCT/US2017/056907
§ 371 (c)(1),
(2) Date: Apr. 17, 2019

(87) PCT Pub. No.: WO2018/075470
PCT Pub. Date: Apr. 26, 2018

(65) Prior Publication Data

US 2020/0052369 A1 Feb. 13, 2020

Related U.S. Application Data

(60) Provisional application No. 62/409,611, filed on Oct. 18, 2016.

(51) Int. Cl.
*H01Q 1/22* (2006.01)
*G21F 5/06* (2006.01)
(Continued)

(52) U.S. Cl.
CPC ..... *H01Q 1/22* (2013.01); *B65D 81/3825* (2013.01); *G08C 17/00* (2013.01); *G21F 5/06* (2013.01);
(Continued)

(58) Field of Classification Search
CPC .... H01Q 1/22; H01Q 1/27; G21F 5/00; G21F 5/06
See application file for complete search history.

(56) References Cited

U.S. PATENT DOCUMENTS 5,877,100 A 3/1999 Smith et al.
6,090,439 A 7/2000 Menon et al.
(Continued)

FOREIGN PATENT DOCUMENTS

WO WO 2006/074465 7/2006

OTHER PUBLICATIONS

International Search Report and Written Opinion dated Dec. 28, 2017 in International Patent Application No. PCT/2017/056907.
(Continued)

*Primary Examiner* — Jason Crawford
(74) *Attorney, Agent, or Firm* — Byrne Poh LLP; Nina R. Horan

(57) ABSTRACT

The present disclosure provides a linked antenna pair for a shipping container having a thermally insulated and electromagnetically shielded cavity for holding a payload. The linked antenna pair comprises a first antenna disposed inside the cavity, a second antenna disposed outside the cavity, and a feed line that electrically connects the first antenna to the second antenna.

15 Claims, 7 Drawing Sheets

(51) Int. Cl.

| | |
|---|---|
| ***H01Q 1/27*** | (2006.01) |
| ***G21F 5/00*** | (2006.01) |
| ***B65D 81/38*** | (2006.01) |
| ***G08C 17/00*** | (2006.01) |
| *B65D 88/12* | (2006.01) |
| *G21F 1/12* | (2006.01) |
| *G08C 19/00* | (2006.01) |
| *H01Q 21/00* | (2006.01) |

(52) U.S. Cl.
CPC ..... *B65D 88/12* (2013.01); *G08C 19/00* (2013.01); *G21F 1/125* (2013.01); *G21F 5/00* (2013.01); *H01Q 1/27* (2013.01); *H01Q 21/00* (2013.01)

(56) References Cited

U.S. PATENT DOCUMENTS 6,315,971 B1 11/2001 Wallace et al.
6,344,240 B1 2/2002 Menon et al.
7,005,181 B2 2/2006 Albert et al.
7,126,552 B2 * 10/2006 Locatelli ..... G06K 7/10178 343/731
7,521,485 B2 4/2009 Albert et al.
8,071,657 B2 12/2011 Albert et al.
8,436,061 B2 5/2013 Albert et al.
9,476,635 B2 10/2016 Nelson
2006/0255946 A1 * 11/2006 Khatri ..... G06K 19/077 340/572.7
2007/0075075 A1 4/2007 Jaeger et al.
2007/0200765 A1 * 8/2007 Meyers ..... H01Q 21/0087 343/700 MS
2007/0205946 A1 * 9/2007 Buris ..... H01Q 9/0407 343/700 MS
2007/0268134 A1 * 11/2007 Twitchell, Jr. ..... G06Q 10/08 340/568.1
2008/0136624 A1 6/2008 Twitchell
2008/0191961 A1 * 8/2008 Tuttle ..... H04B 7/15507 343/893
2009/0016308 A1 * 1/2009 Twitchell, Jr. ..... H01Q 1/2208 370/338
2009/0073077 A1 3/2009 Reinheimer et al.
2009/0290512 A1 * 11/2009 Twitchell, Jr. ..... G06Q 10/08 370/254
2010/0201486 A1 * 8/2010 Greene ..... G06K 19/07749 340/10.1
2010/0289669 A1 * 11/2010 Saltzman ..... H04Q 9/00 340/870.17
2011/0273362 A1 11/2011 Tuttle
2012/0142991 A1 6/2012 Singh et al.
2012/0252488 A1 10/2012 Hartmann et al.
2014/0070943 A1 * 3/2014 Breed ..... B60R 21/01516 340/539.11
2014/0353317 A1 12/2014 Ranade et al.
2014/0367393 A1 12/2014 Ranade
2015/0148855 A1 * 5/2015 Szakelyhidi ..... H01Q 1/2208 607/5
2018/0019518 A1 * 1/2018 Man ..... H01Q 1/22
2020/0052369 A1 * 2/2020 Kilmer ..... G21F 5/06

OTHER PUBLICATIONS

Extended European Search Report dated Jul. 17, 2020 in EP Patent Application No. 17861296.6, pp. 1-8.

* cited by examiner

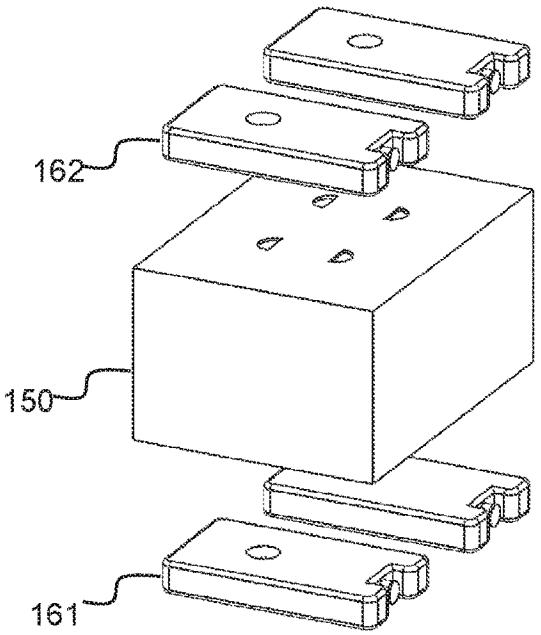
FIG. 1B – Prior Art
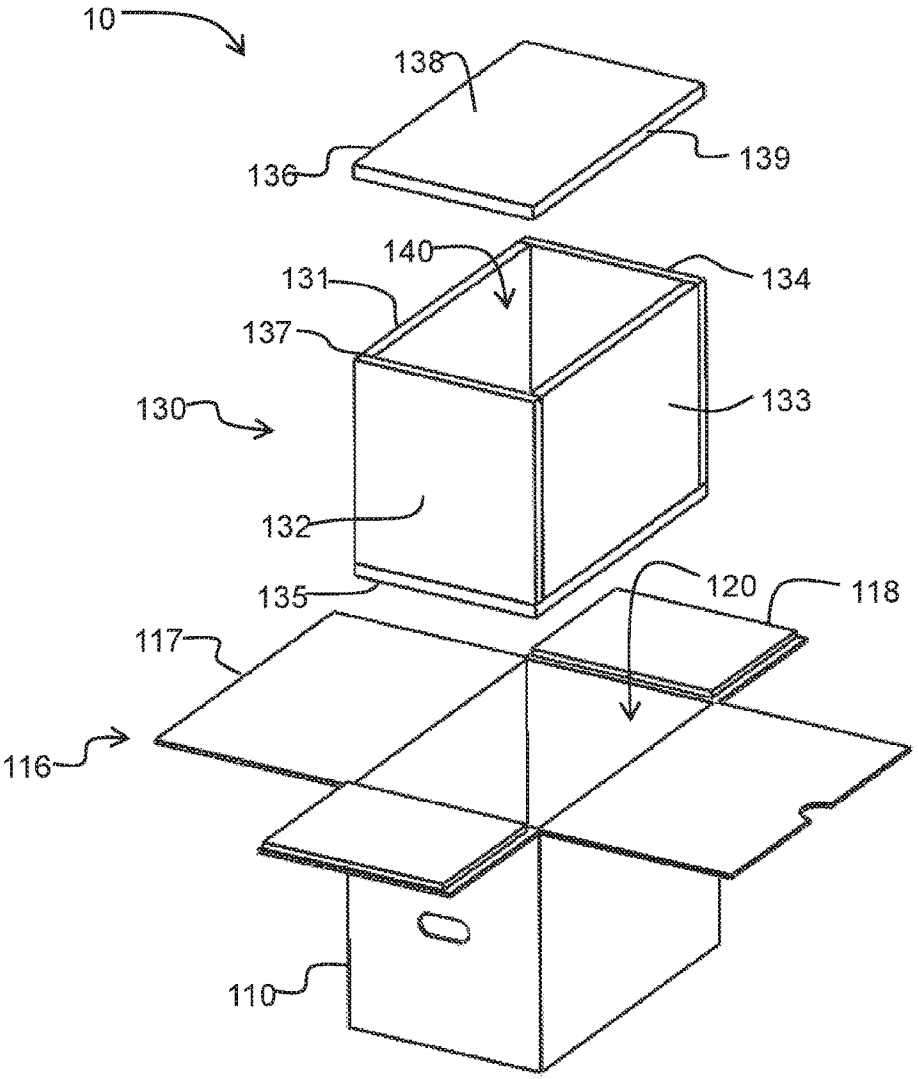
FIG. 1A – Prior Art

LINKED ANTENNA PAIR FOR TRANSMISSION THROUGH SHIELDED SHIPPING CONTAINER

1. BACKGROUND

In the temperature-controlled shipping industry it is important to maintain the temperature of a payload at or near a desired temperature for an extended length of time. FIGS. 1A and 1B show exploded views of elements of a prior art shipping container for temperature-controlled shipping. Insulated shipping container 10 includes an outer box 110 with a lid 116 having an open position and a closed position. Lid 116 has four hinged lid flaps 117 that extend respectively from corresponding walls. When the lid 116 is in its closed position, outer box 110 and its lid 116 define an enclosure 120 within outer box 110. Opening lid 116 permits access to the enclosure 120. Outer box 110 provides structural protection for the contents and is typically made of corrugated cardboard, wood, metal or plastic, for example.

A plurality of thermally insulating members is disposed within enclosure 120. The plurality of insulating members includes an insulating body 130 and an insulating cover 136. Thermally insulating cover 136 has an open position such that it is removed from insulating body 130 and a closed position such that it is it is in contact with insulating body 130. When lid 116 of outer box 110 is in its closed position and insulating cover 136 is in its closed position, insulating cover 136 is proximate to lid 116.

Insulating body 130 can be assembled from discrete vacuum insulation panels (VIP) 131-135 that are held in contact with each other as shown in FIG. 1A. Vacuum insulation panel 135 forms the base of the insulating body 130 and vacuum insulation panels 131-134 form the walls, extending away from the base VIP 135. Vacuum insulation panels are a preferred insulating material for both the insulating body 130 and the insulating cover 136 for extended duration temperature control because of their excellent thermal insulating properties.

Insulating cover 136 is also a vacuum insulation panel and can be held in contact with the top of VIP walls 131-134 of insulating body 130 when the lid 116 of outer box 110 is in its closed position. As shown in FIG. 1A, lid flaps 117 at the right hand and left hand sides of outer box 110 have an attached compressible lid flap cushion 118. In addition, a compressible bottom cushion (not shown) can be inserted into the bottom of enclosure 120. When lid 116 is closed and sealed, the lid flap cushion 118 and the bottom cushion are compressed and provide pressure to force insulating cover 136 into contact with the top of insulating body 130.

Each of vacuum insulation panels 131-136 has a pair of opposing faces 138 and four edges 139. Adjacent vacuum insulation panels are held in close contact with an edge 139 of one vacuum insulation panel butted into a face 138 of an adjacent vacuum insulation panel to form a seam 137. Optionally there can be adhesive at seam 137. Alternatively, the adjacent vacuum insulation panels are held in contact with each other by a structure such as outer box 110.

When insulating cover 136 is closed onto insulating body 130, the insulating body 130 and the insulating cover 136 define a thermally insulated cavity 140 within which a payload 150 (FIG. 1B) is placed. At least one temperature control material, such as lower phase change material 161 and upper phase change material 162 (FIG. 1B), is placed in proximity to the payload 150 within insulated cavity 140 for maintaining the temperature of the payload 150 at a desired temperature for an extended period of time, even if the outside ambient temperature is significantly higher or lower.

Each of the vacuum insulation panels 131-136 includes a porous core material, such as an open cell foam, that is evacuated and enclosed within an envelope having low permeability to air in order to maintain the evacuated state. The envelope is made of a gas-barrier metallized plastic film. Vacuum insulation panels 131-135 in insulating body 130 and insulating cover 136 are held in close contact with each other with tight seams 137 between panels in order to provide good thermal insulation of cavity 140. The metallized films of the vacuum insulation panels 131-136 also provide electromagnetic shielding, so that insulating body 130 and insulating cover 136 form an electromagnetically shielding assembly. In other words, cavity 140 is both thermally insulated and electromagnetically shielded.

It is desirable to remotely obtain, monitor, or read parameters that characterize conditions within cavity 140 (e.g., temperature, humidity, barometric pressure, vibration, acceleration, or strain) during shipment, without opening shipping container. However, as a result of the electromagnetic shielding of the vacuum insulation panels in the insulating body 130 and the insulating cover 136, wireless transmission of signals from inside cavity 140 is too severely attenuated to permit remote reading of the signals. In addition, further signal attenuation can occur when shipping containers are stacked adjacent to or on top of each other.

2. SUMMARY OF THE DISCLOSURE

The present disclosure provides a shipping container having a thermally insulated and electromagnetically shielded cavity for holding a payload. A linked antenna pair includes a first antenna disposed inside the cavity, a second antenna disposed outside the cavity, and a feed line electrically connecting the first antenna to the second antenna.

Advantageously, the shipping container of the disclosure facilitates reliable signal transmission between a wireless communication device inside the cavity and a wireless reader outside the cavity.

In addition, conditions inside the cavity can be remotely monitored from outside the shipping container without opening the shipping container.

3. BRIEF DESCRIPTION OF THE DRAWINGS

FIGS. 1A and 1B show exploded views of a prior art shipping container;

Figure 2:
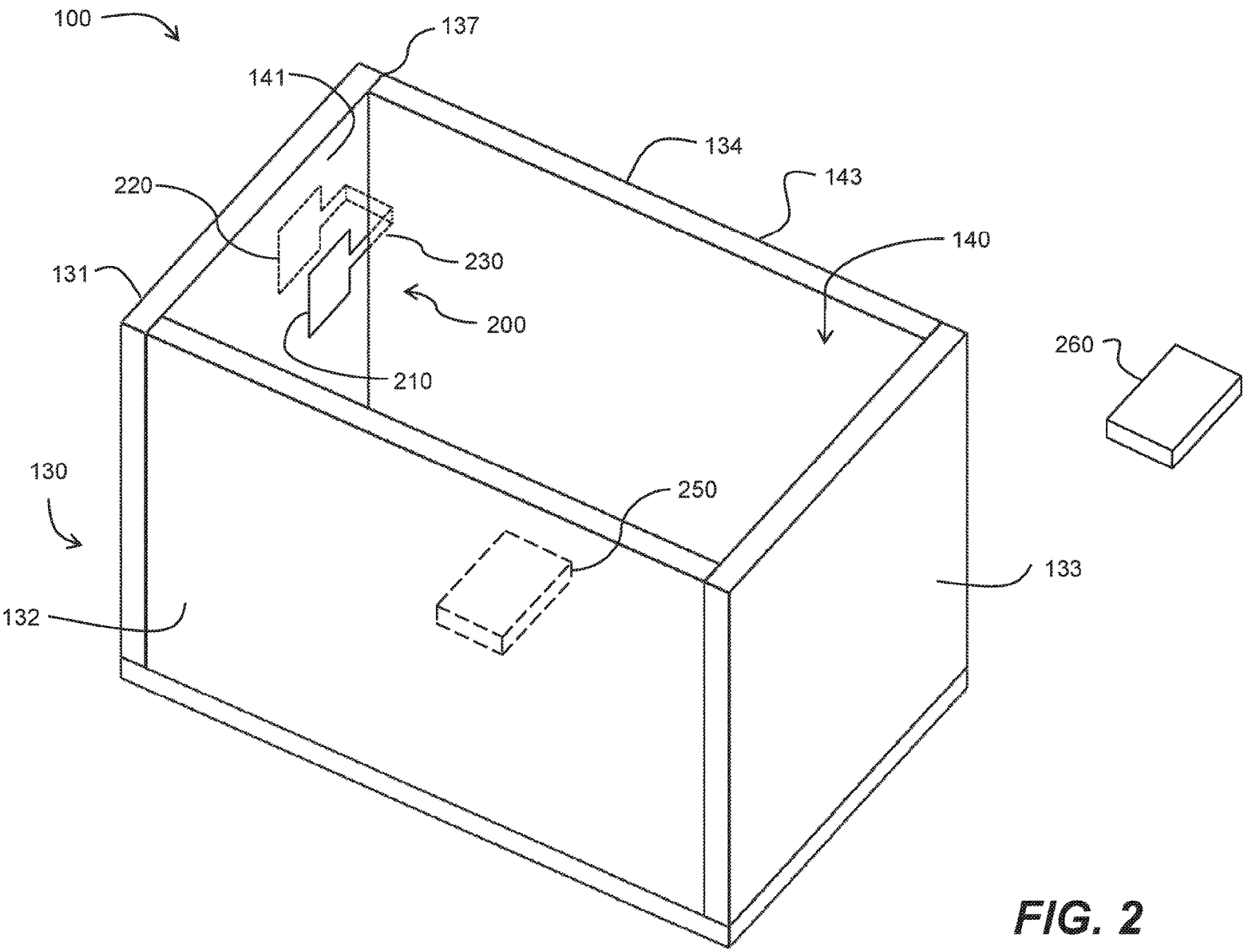
FIG. 2 shows a perspective view of an insulating body of a shipping container that includes a linked antenna pair according to an embodiment of the disclosure.

It is understood that the figures are not drawn to scale. Relative sizes of elements shown in the figures are not meant to be limiting.

4. DETAILED DESCRIPTION

The invention includes the following:

1. A shipping container comprising:
a thermally insulated and electromagnetically shielded cavity for holding a payload; and
a linked antenna pair comprising:
a first antenna disposed inside the cavity;
a second antenna disposed outside the cavity; and
a feed line electrically connecting the first antenna to the second antenna.
2. The shipping container of the above 1, further comprising:
an insulating body comprising a plurality of vacuum insulation panels assembled together; and
an insulating cover comprising a vacuum insulation panel that is removably assembled onto the insulating body to define the cavity, wherein each of the vacuum insulation panels in the insulating body and the insulating cover includes an evacuated porous core and a low permeability gas-barrier metallized film.
3. The shipping container of the above 2, wherein the feed line passes through a seam between two adjacent vacuum insulation panels.
4. The shipping container of the above 2, wherein the first antenna is affixed to an inner face of a first vacuum insulation panel.
5. The shipping container of the above 4, wherein the second antenna is affixed to an outer face of the first vacuum insulation panel.
6. The shipping container of the above 4, wherein the second antenna is affixed to an outer face of a second vacuum insulation panel adjacent to the first vacuum insulation panel.
7. A shipping container comprising:
a thermally insulated and electromagnetically shielded cavity for holding a payload; and
a flexible printed wiring member, comprising a linked antenna pair;
the linked antenna pair comprising:
a first antenna disposed inside the cavity;
a second antenna disposed outside the cavity; and
a feed line electrically connecting the first antenna to the second antenna.
8. The shipping container of the above 7, wherein the flexible printed wiring member comprises a first metal signal layer in which the feed line, a portion of the first antenna, and a portion of the second antenna are formed.
9. The shipping container of the above 8, wherein the flexible printed wiring member further comprises:
a second metal layer; and
a first dielectric layer disposed between the first metal signal layer and the second metal layer.
10. The shipping container of the above 9, wherein the second metal layer is discontinuous.
11. The shipping container of the above 9, wherein the flexible printed wiring member further comprises:
a third metal layer; and
a second dielectric layer disposed between the first metal layer and the third metal layer.
12. The shipping container of the above 7, wherein the first antenna has a first length and the second antenna has a second length, wherein the first length and the second length are substantially equal.
13. The shipping container of the above 7, wherein the first antenna has a first width, the second antenna has a second width, and the feed line has a third width, wherein the third width is smaller than both the first width and the second width.
14. The shipping container of the above 13, wherein the first width is different from the second width.
15. The shipping container of the above 7, wherein the first antenna is associated with a first ground plane, the second antenna is associated with a second ground plane and the feed line is associated with a third ground plane.
16. The shipping container of the above 15, wherein the first ground plane, the second ground plane and the third ground plane are formed in a single metal layer.
17. The shipping container of the above 7, wherein the linked antenna pair further comprises:
a first dielectric having a first height disposed between a first signal layer and a first ground plane associated with the first antenna;
a second dielectric having a second height disposed between a second signal layer and a second ground plane associated with the second antenna; and
a third dielectric having a third height disposed between a third signal layer and a third ground plane associated with the feed line, wherein the third height is less than both the first height and the second height.
18. The shipping container of the above 1 or 7, further comprising a radiation absorbing material disposed at or near the members defining the cavity.
19. The shipping container of the above 1 or 7, further comprising a wireless communication device located within the electromagnetically shielded cavity.
20. The shipping container of the above 19, further comprising a sensor inside the cavity associated with the wireless communication device.
21. The shipping container of the above 19, wherein the first antenna and the wireless communication device are disposed in predetermined locations within the cavity.
22. The shipping container of the above 21, wherein a pair of opposing sides of the cavity is separated by a first distance and the first antenna and the wireless communication device are separated by a second distance, is the second distance being less than half of the first distance.

4.1 Definitions

Unless defined otherwise, all technical and scientific terms used herein have the same meaning as those commonly understood by one of ordinary skill in the art to which this invention belongs. Although methods and materials similar or equivalent to those described herein can be used in the practice or testing of the present invention, suitable methods and materials are described below. The materials, methods and examples are illustrative only, and are not intended to be limiting. All references, publications, patents, patent applications and other documents mentioned herein are incorporated by reference in their entirety. Unless clearly indicated otherwise, the following terms as used herein have the meanings indicated below.

Throughout this specification, the word "comprise" or variations such as "comprises" or "comprising" will be understood to imply the inclusion of a stated integer or groups of integers but not the exclusion of any other integer or group of integers.

The terms "include", "includes", "including", "have", "has", and "having" will be understood as open-ended and non-limiting, unless specifically stated otherwise.

The term "a" or "an" may mean more than one of an item.

The terms "and" and "or" may refer to either the conjunctive or disjunctive and mean "and/or".

The term "about" means within plus or minus 10% of a stated value. For example, "about 100" would refer to any number between 90 and 110.

The term "vacuum insulation panels", abbreviated as "VIPs" is well known in the art and comprises a core material contained within a sealed enclosure, from which air has been evacuated. The core material may be made from any open cell material, including, but not limited to, polystyrene, polyurethane, fiberglass, silica and various forms of organic foams. Suitable core materials include, but are not limited to, AEROCORE (available from American Aerogel Corporation), NANOGEL (available from Nanopore), and those disclosed in U.S. Pat. Nos. 8,436,061, 8,071,657, 7,521,485, 7,005,181, 6,344,240, 6,315,971, 6,090,439, and 5,877,100.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

4.2 Shipping Container with a Linked Antenna Pair

In one embodiment, the present disclosure provides a shipping container having a thermally insulated and electromagnetically shielded cavity for holding a payload. A linked antenna pair includes a first antenna disposed inside the cavity, a second antenna disposed outside the cavity, and a feed line electrically connecting the first antenna to the second antenna.

FIG. 2 shows an embodiment that can be used to facilitate transmission of signals between the inside and the outside of the shielded cavity 140 within the insulating body 130 of a shipping container 100 (insulating cover 136 not shown). A wireless communication device 250 is placed within the insulating body 130. Wireless communication device 250 can be a data logger, such as a temperature logger, which provides information about the temperature inside shielded cavity 140. A linked antenna pair 200 including a first antenna 210 is disposed inside shielded cavity 140, a second antenna 220 is disposed outside shielded cavity 140, and a feed line 230 electrically connects first antenna 210 and second antenna 220 in hard wire fashion. Linked antenna pair 200 functions as a passive repeater for bi-directional signal transmission. Linked antenna pair is passive, meaning it does not require a power source such as a battery. First antenna 210, located inside the shielded cavity 140, can send signals to and receive signals from wireless communication device 250. Similarly, second antenna 220, located outside shielded cavity 140, can send signals to and receive signals from a wireless reader 260 also located outside the shielded cavity 140. Feed line 230 passes between adjacent VIPs 131 and 134 at seam 137, wraps around edge 139 of VIP wall 131, and transmits signals between first antenna 210 and second antenna 220. Thus, the linked antenna pair 220 facilitates communication between wireless communication device 250 inside shielded cavity 140 and the wireless reader 260 outside shielded cavity 140.

In the embodiment shown in FIG. 2, first antenna 210 is affixed to inner face 141 of VIP wall 131, and second antenna 220 is affixed to outer face 142 of VIP wall 131. The first and second antenna may be affixed to the VIP walls by methods known in the art, for example, by an adhesive backing. In another embodiment, one or both of first antenna 210 and second antenna 220 are affixed to structures other than the VIP walls inside or outside the cavity 140, respectively. In another embodiment, one or both of first antenna 210 and second antenna 220 are loosely positioned inside or outside of cavity 140. In another embodiment, one or both of first antenna 210 and second antenna 220 extend in directions that are not parallel to the VIP walls.

Referring back to FIG. 2, feed line 230, passes through seam 137 along inner face 141, wraps around edge 139 of VIP wall 131, and extends along outer face 142 of VIP wall 131 to connect to second antenna 220.

The configuration of first antenna 210 on the inner face of a VIP panel and second antenna 220 on the outer face of the same VIP panel can be used on any of the VIP panels 131-135 of insulating body 130, as well as on the inner face and outer face of insulating cover 136.

Location of the linked antenna pair 200 will depend on factors such as the size of the shipping container, VIP configuration, possibility of damage to the linked antennae pair, the location of wireless communication device, the location of the phase change materials, and extent of visibility of the external antenna to the reader. Placing the linked antenna pair on the insulating cover can provide a modular configuration and a wireless-enabled shipping container.

Figure 3:
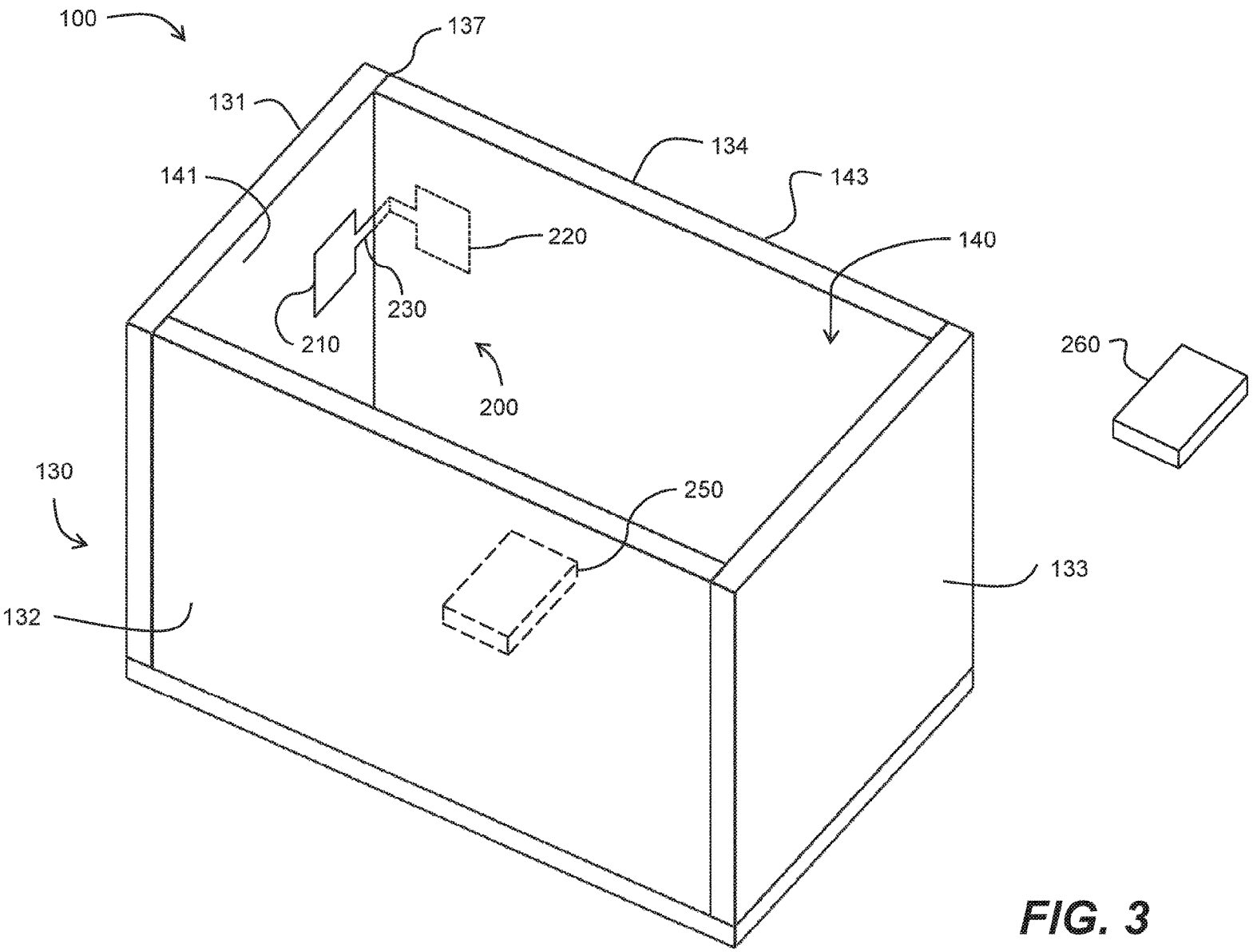
FIG. 3 shows a perspective view of an insulating body of a shipping container that includes a linked antenna pair according to another embodiment of the disclosure.

While FIG. 2 shows the first antenna 210 and the second antenna 220 located on the inner face 141 and the outer face 142, respectively, of the same VIP panel, the first antenna and second antenna can be located on two adjacent VIP panels. As shown in FIG. 3, first antenna 210 is affixed to inner face 141 of VIP wall 131, and second antenna 220 is affixed to outer face 143 of adjacent VIP wall 134. Feed line 230 passes through seam 137 along inner face 141, wraps around the corner of adjacent VIP wall 134, and extends along outer face 143 of VIP wall 134 to connect to second antenna 220.

The linked antenna pair can be made in layers using flexible printed wiring fabrication technology.

Figure 4C:
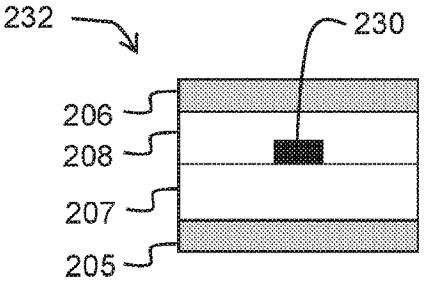
FIGS. 4B-4E show cross-sectional views of examples of the linked antenna pair of FIG. 4A.
Figure 4B:
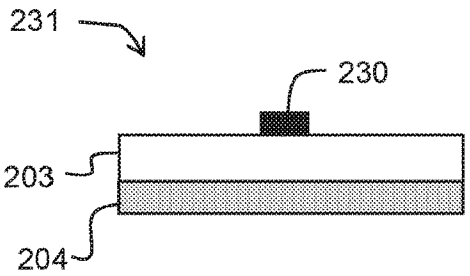
Figure 4A:
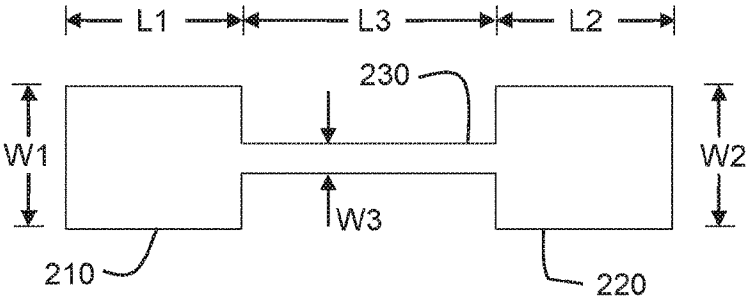
FIG. 4A shows a top view of a linked antenna pair made by flexible printed wiring fabrication technology.

FIG. 4A provides a top view of linked antenna pair 200 in a flat configuration prior to placement on the VIP. Only the top metal layer of linked antenna pair 200 is shown in FIG. 4A. First antenna 210 has a rectangular shape with length L1 and width W1. Second antenna 220 has a rectangular shape with length L2 and width W2. Feed line 230 has a length L3 and a width W3. Length L1 of first antenna 210 and length L2 of second antenna 220 are designed to be proportional to the wavelength of the radiated waves used by the wireless communication device 250 and the wireless reader 260. FIGS. 4A-4E show a simple rectangular antenna configuration (sometimes called a patch antenna) in which signal layer 201 is separated from a ground plane 204 by a dielectric 203. In this configuration, it is preferred that L1 and L2 are substantially equal to a half wavelength in the dielectric 203. The frequency used by the wireless communication device 250 and the wireless reader 260 is typically within the range of 800 MHz to 10 GHz. At 3 GHz, for example, the wavelength in air is 10 cm. The wavelength in the dielectric 203 is inversely proportional to the square root of the dielectric constant. The dielectric constant (also known as the relative permittivity) of a typical dielectric used in printed wiring is around 4 (within a range of about 2 to 5 depending upon the dielectric used), so the wavelength in such a dielectric would be about half the wavelength in air. In this example, an appropriate length for L1 and L2 would be approximately 2.5 cm. More generally, whatever their geometries, first antenna 210 and second antenna 220 are configured to operate at a frequency used by the wireless communication device 250 and wireless reader 260. Length L3 of feed line 230 is largely determined by the distance required to pass through the seam between two adjacent vacuum insulation panels and bend around the edge to place first antenna 210 and second antenna 220 in their desired positions.

Width of a patch antenna affects input impedance and bandwidth. First antenna 210 is located within a shielded cavity and has a different environment than second antenna 220. In some embodiments, it is advantageous for width W1 of first antenna 210 to be different from width W2 of second antenna 210.

While FIG. 4A shows the first antenna having the same size and shape as that of the second antenna, in other embodiments, the first antenna and second antenna have different sizes and shapes. For example, in one embodiment, the first and second antennae can be square, circular or elliptical. In other embodiments, the first and second antenna can be any shape made using flexible printed wiring technologies, including spiral or serpentine conductive traces as radiating elements.

FIGS. 4B and 4C show cross-sectional views of linked antennae pair of FIG. 4A along 1-1' of feed line 230. FIG. 4B shows the cross-sectional view of a microstrip transmission line 231. The microstrip transmission line 231 includes a conductor, such as feed line 230 separated from a ground plane 204 by a dielectric 203 and is readily made using flexible printed wiring technology. Typically, the first antenna 210 is associated with a first ground plane, the second antenna 220 is associated with a second ground plane and the feed line 230 is associated with a third ground plane. In the example of FIG. 4B, the first ground plane, the second ground plane and the third ground plane are all formed in a single metal layer 204.

FIG. 4C shows a cross-sectional view of a stripline transmission line 232. A stripline transmission line is similar to a microstrip transmission line, but the feed line 230 is located between two ground planes 205 and 206 that are separated from feed line 230 by a pair of dielectric layers 207 and 208.

Figure 4E:
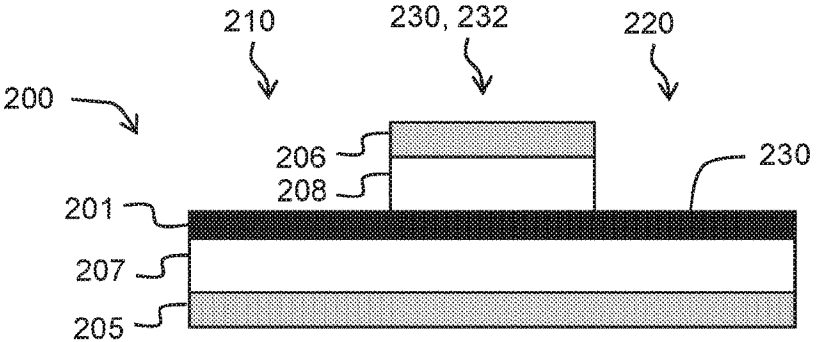
Figure 4D:
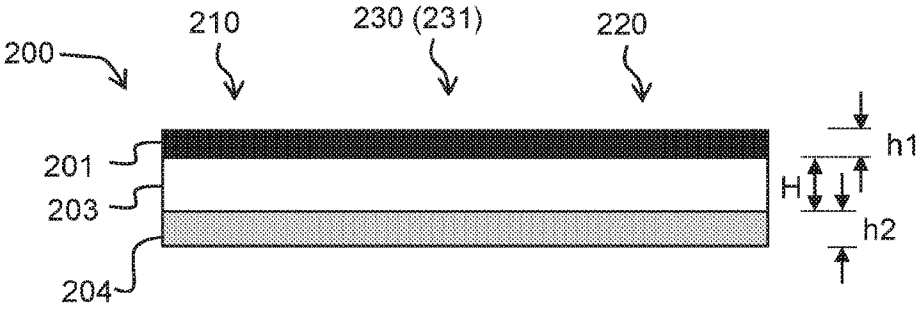

FIGS. 4D and 4E show cross-sectional views of linked antennae pair of FIG. 4A along 2-2' of feed line 230. FIG. 4D shows a cross-sectional view of microstrip transmission line 231. Feed line 203 and radiating portions of first antenna 210 and second antenna 220 are formed in first metal signal layer 201 and can be patterned as shown in FIG. 4A. Second metal layer 204 functions as a ground plane for first antenna 210, second antenna 220 and feed line 230. A dielectric layer 203 is disposed between the first metal signal layer 201 and the second metal layer 204. First metal layer 201 and second metal layer 204 have heights h1 and h2 respectively. Dielectric layer 203 has a height H. FIG. 4E shows a cross-sectional view of stripline transmission line 232.

Heights h1 and h2 of the first and second metal layers typically do not have a large impact on electrical performance at high frequencies, but antenna efficiency can decrease if height H between the first metal layer 201 and the second metal layer 204 is too small. Antenna efficiency is a measurement of how much energy put into the antenna gets radiated into free space rather than lost as heat on the antenna's structure or reflected back into the source. Other important antenna performance attributes include directivity, gain and bandwidth.

Directivity is the ratio of the power density in the radiation pattern maximum to the average power density at a uniform distance from the antenna. Antenna gain is the product of directivity and efficiency. Antenna bandwidth is the frequency range over which the antenna's properties are acceptable.

In other embodiments, first antenna 210 or second antenna 220 includes a plurality of antenna elements to improve antenna performance. For example, second antenna 220 can include an array of two or more antenna elements to modify directivity and bandwidth to facilitate improved reception from a wireless reader 260. Improved reception can be important in situations in which the wireless reader is positioned in an unpredictable location and orientation relative to shipping container 100. The two or more antenna elements in the array can have different shapes or configurations.

In addition to electrical performance of the linked antenna pair 200, the undesired thermal effects of linked pair antenna 200 need to be considered. Excellent thermal insulation of cavity 140 requires that there be substantially no gap between the assembled vacuum insulation panels 131-135 of insulating body 130, and between insulating body 130 and the vacuum insulation panel of insulating cover 136. If the hard wire connection between first antenna 210 and second antenna 220 is too thick, a large gap will result, causing unacceptable heat transfer between cavity 140 and the environment will occur. This heat transfer will reduce the duration that payload temperature can be maintained within a desired range. In the example shown in FIG. 4D, it is possible to have the total thickness h1+H+h2 to be as small as about 75-100 microns (about 0.075-0.1 mm or about 0.003-0.004 inch). In other embodiments, where the various layer thicknesses are increased to improve electrical performance, such as height H of first dielectric layer 203, total thickness h1+H+h2 can be larger, such as about 250 microns. Similarly, if a stripline 232 transmission line is used (FIG. 4E), the total thickness in the region of feed line 230 that needs to pass through a seam 137 of adjacent vacuum insulation panels will typically be about 125 microns or greater. Adjacent vacuum insulation panels can be compressed or deformed a modest amount at the seam 137 to accommodate the passage of the feed line 230 through the seam 137 without forming a large enough gap to compromise thermal performance to an unacceptable extent.

In some embodiments, thermal conduction along the metal layers of linked antenna pair 200 from inside the cavity 140 to outside the cavity 140 needs to be considered. Width W3 of feed line 230 is typically less than both width W1 of first antenna 210 and width W2 of second antenna 220 as shown in FIG. 4A, but the second metal layer 204 is fairly wide as shown in FIG. 4B. Typically, the second metal layer 204 (serving as a ground plane) will be wider than the first metal signal layer 201 in corresponding regions.

Figure 5B:
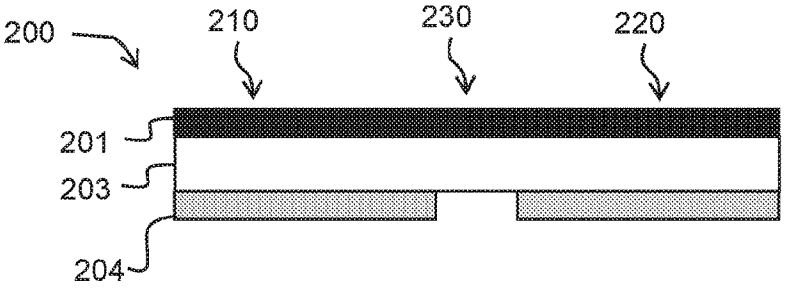
FIGS. 5B and 5C show cross-sectional views of linked antenna pairs according to another embodiment.
Figure 5D:
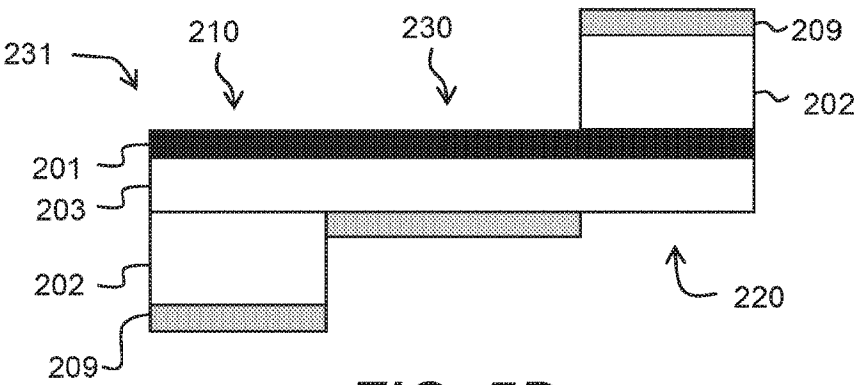
FIG. 5A shows a top view of another embodiment of a linked antenna pair including a ground plane.
Figure 5A:
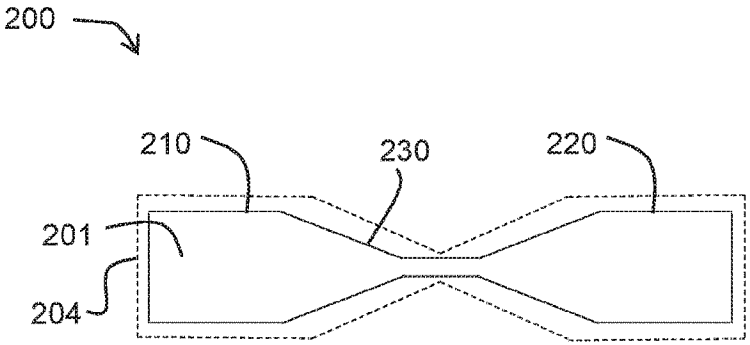

FIG. 5A shows a top view of a linked pair of antenna 200. According to this embodiment, the first metal layer 201 and the second metal layer 204 have a narrower width in the region of feed line 230 than in the regions of first antenna 210 and second antenna 220. This narrowing width provides a smaller cross-sectional area and a reduced heat conduction rate through the metal layers from inside cavity 140 to outside cavity 140. FIG. 5A also shows the second metal layer 204 (ground plane) extending beyond the first metal layer 201 (signal layer) by a distance equivalent to several times the height H of the dielectric. Making the signal layer 201 smaller in area than the ground plate 204 can improve performance of the linked pair of antenna. In other words, the length and the width of the ground plane for first antenna 210 can be approximately L1+6H and W1+6H respectively, for example. FIG. 5A also shows an example of a gradual transition in width provided by sloped edges.

FIG. 5B shows a reduction of the width of second metal layer 204 by making it discontinuous in the region of feed line 230 that passes through the seam 137. This embodiment relies on the metal layers of adjacent VIPs at the seam 137 to function as a ground plane and the plastic film of the VIPs to function as a dielectric layer. This embodiment advantageously reduces thermal conduction through the VIP seam.

Figure 5C:
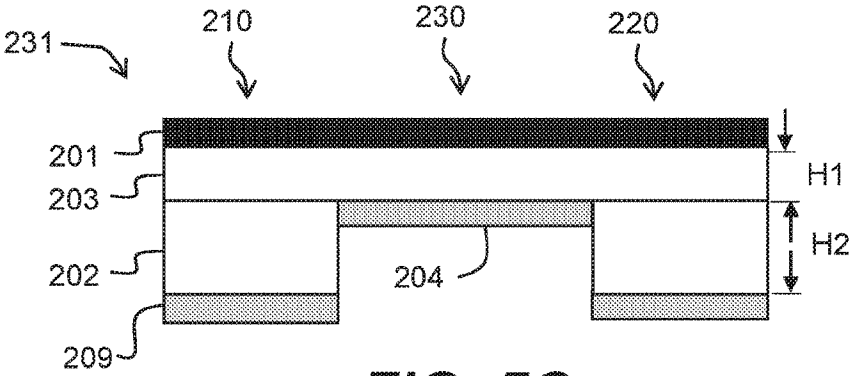

As mentioned above, antenna efficiency can decrease if the height H between the first metal layer 201 and the second metal layer 204 is too small. In some embodiments, a small height H1 of dielectric is provided at the feed line 203 region for passing through the seam 137, and a larger height H1+H2 of dielectric can be provided at first antenna 210 and at second antenna 220, as shown in FIG. 5C. Second metal layer 204 can be patterned to extend only within the region of feed line 230. Using rigid-flex printed wiring technology, for example, a thicker dielectric 202 (thickness H2) with a ground plane 209 can be provided at first antenna 210 and at second antenna 220. In some embodiments, second metal layer 204 is extended to overlap with ground plane 209 to a sufficient extent that second metal layer 204 can be electrically connected to ground plane 209 by conductive vias through dielectric 203. In some embodiments, dielectric 202 can have a different geometry at first antenna 210 than at second antenna 220.

The configuration of linked antenna pair 200 shown in FIG. 5C can be used in situations in which the feed line 230 is placed in a U-shape around the edge 139 of a single vacuum insulation panel as in FIG. 2. In this configuration, ground plane layer 209 of first antenna 210 faces the inner side 141 of the vacuum insulation panel, and ground plane layer 209 of second antenna 220 faces the outer side 142 of the vacuum insulation panel.

The configuration of linked antenna pair 200 shown in FIG. 5D can be used in situations in which the feed line 230 is placed around two adjacent vacuum insulation panels as in FIG. 3. In this configuration, ground plane layer 209 of first antenna 210 faces the inner side 141 of a vacuum insulation panel, and ground plane layer 209 of second antenna 220 faces the outer side 143 of the adjacent vacuum insulation panel.

The configuration of the linked antenna pair 200 shown in FIG. 5D is more complicated than the configuration shown in FIG. 5C, because the dielectric 202 for both antennas can be provided by a single dielectric layer for the configuration shown in FIG. 5C, but not for the configuration shown in FIG. 5D (and similarly for the ground plane 209).

The configurations of linked antenna pair 200 shown in FIG. 4D or FIG. 5C can be used in the shipping container of FIG. 3. In these configurations, the linked antenna pair 200 of FIG. 4D or FIG. 5C can be twisted in half in the region of feed line 203 to orient the ground planes in the correct directions.

In some embodiments, markings are printed on the linked antenna pair 200 to facilitate correct placement of the linked antenna pair 200, i.e., so that the appropriate length is exposed on the interior and exterior sides of the insulating body 130 or insulating cover 136 for proper function of first antenna 210 and second antenna 220.

In other embodiments, prior to placement onto the insulating body or insulating cover, the linked antenna pair can be pre-creased in the region of the feed line, to facilitate correct placement and assembly.

In the embodiments described above, the linked antenna pair is formed in planar configurations in which the antenna signal element is parallel to the ground plane.

Figure 6B:
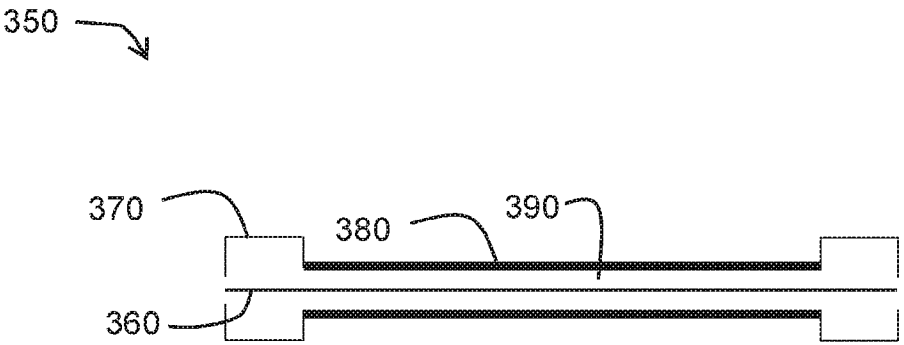
FIG. 6B shows a coaxial cable useful in some embodiments of the disclosure.
Figure 6A:
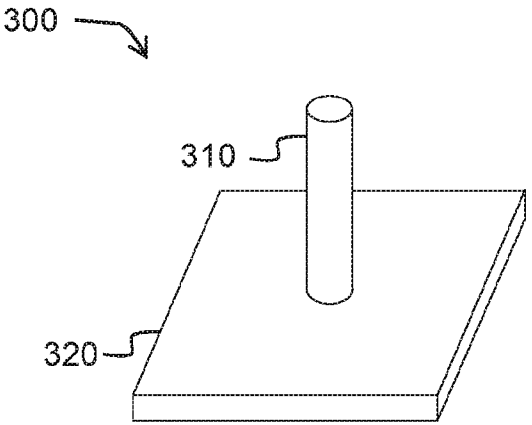
FIG. 6A shows a quarter wave monopole antenna useful in some embodiments of the disclosure.

FIG. 6A shows a quarter-wave monopole antenna 300 in which the antenna signal element 310 has a length of one quarter wavelength of the transmission frequency of interest (for example, a length of about 2.5 cm for about 3 GHz frequency). The antenna signal element 310 is mounted perpendicular to ground plane 320 (sometimes also called a counterpoise). Quarter-wave monopole antenna can be used for either or both of first antenna 210 and second antenna 220.

In other embodiments, a half-wave dipole antenna can be used for either or both of first antenna 210 and second antenna 220. In these embodiments, feed wire 203 can include a single small diameter wire, such as about 0.01 inches (30 gauge) or less. Alternatively, feed wire 203 can include twin-lead cable. In other embodiments, as shown in FIG. 6B, feed wire 203 can be a disconnectable coaxial cable 350 having a central signal line 360, an outer shield 370, a dielectric insulator 390 between the central signal line 360 and the outer shield 370, as well as jacket insulation 380. Coaxial cable 350 has excellent signal transmission performance, but even a small diameter format, such as microcoax, has a cable diameter of about 1.1 mm (about 0.045 inch) which, in some application, can make the gap between adjacent vacuum insulation panels too large.

In some embodiments, a single small-diameter wire of appropriate length can be used as the linked antenna pair. The length of the wire is selected to provide a first length located inside cavity 140, a third length for passing through the seam 137, and a second length located outside cavity 140. The first and second lengths are selected for best antenna performance. The metallized layer within the film of the vacuum insulation panels can provide some of the functions of ground planes and shielding.

Figure 7:
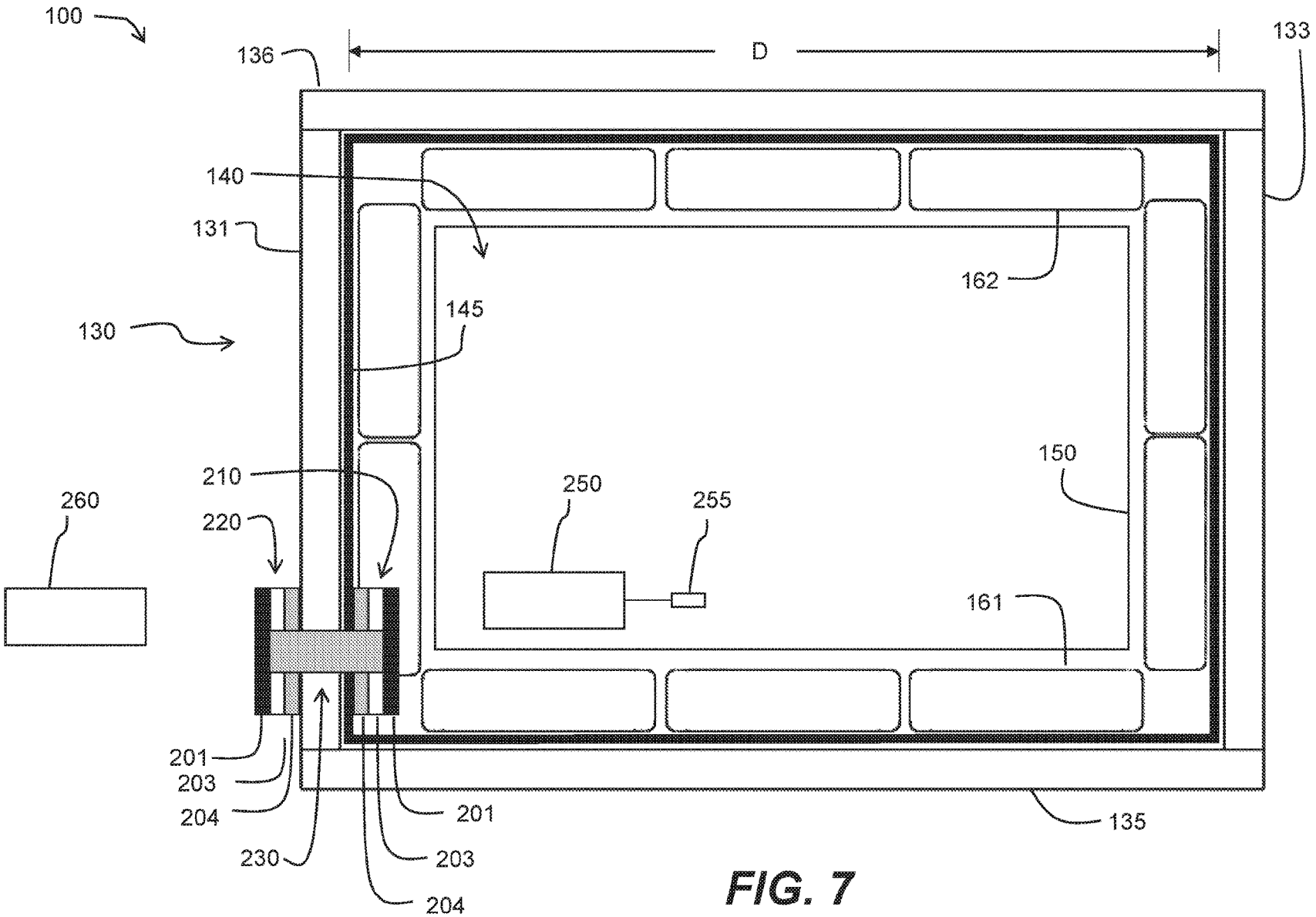
FIG. 7 shows the inside and outside of a shipping container with an associated wireless communication device inside a shielded cavity, a wireless reader outside the cavity, and portions of a linked antenna pair.

FIG. 7 shows a portion of shipping container 100 including insulating body 130 and insulating cover 136, but with VIP wall 132 (FIG. 2) hidden from view in order to provide visibility into cavity 140. First antenna 210 is located proximate to the inner face of VIP wall 131, and second antenna 220 is located proximate to the outer face of VIP wall 131. Feed wire 230 connects first antenna 210 and second antenna 220 at first metal layer 201. First antenna 210 and second antenna 220 are shown as having the configuration of FIG. 4D with first metal layer 201, second metal layer 204 and dielectric layer 203. Second metal layers 204 (ground planes) are closest to the VIP wall 131. First antenna 210 is located proximate to wireless communication device 250 in order to provide close coupling. If the distance between a pair of opposing sides of cavity 140, e.g. the distance between VIP walls (such as VIP walls 131 and 133 of insulating body 130) is D, then it is preferred that the distance between first antenna 210 and wireless communication device 250 is less than D/2. It is more preferable that the distance between first antenna 210 and wireless communication device 250 is less than D/4 or even less than D/10 in some embodiments. To define and maintain the location of wireless communication device 250, it can be placed within a non-shielding structural cradle (not shown). By placing the wireless communication device in a cradle, the relative orientations and positions of first antenna 210 and wireless communication device 250 are predetermined, thereby facilitating reliable signal transmission.

Wireless communication device 250 can be connected to a sensor 255. In some embodiments, sensor 255 is not a separate device but is integrated into wireless communication device 250. In such embodiments, wireless communication device 250 is sometimes called a wireless data logger. For reading temperature within cavity 140, sensor 255 can be a temperature sensor. If a temperature sensor is integrated into wireless communication device 250 the combined unit is sometimes called a wireless temperature logger. Sensors 255 and wireless communication device 250 can monitor and transmit signals related to temperature, humidity, barometric pressure, vibration, acceleration, strain or other physical parameters that characterize conditions within cavity 140. Other types of signals that can be transmitted by wireless communication device 250 include location (GPS), identification (RFID) or cellular data.

To reduce reflections of signals within cavity 140, a radiation absorbing material 145 can be provided at or near the inner faces of vacuum insulation panels, i.e., at or near the members that define cavity 140. Spacers (not shown) can also be used to separate first antenna 210 and second antenna 220 away from the internal and external faces respectively of the vacuum insulation panels. Spacers can be integrated into the linked antenna pair 200, or into the other elements of the shipping container 100, such as cushioning foam or corrugate cardboard.

A plastic liner (not shown) can also be provided adjacent the faces of the vacuum insulation panels in order to provide mechanical protection for them. In some embodiments, at least a portion of the linked antenna pair can affixed to or integrated into the plastic liner.

Lower phase change material 161 and upper phase change material 162 are shown below and above payload 150 in FIG. 7. In some embodiments, phase change materials can be located in additional or alternative locations, such as near VIP walls 131-134. In some embodiments, phase change materials can include polar molecules such as water or hydrated salts or salt/water solutions. Such phase change materials can attenuate signals within cavity 140 and can influence the design of the relative location of first antenna 210 and wireless communication device 250.

Wireless reader 260 is used to locate and communicate with the wireless communication device 250. Wireless reader 260 can be a handheld device, a smart phone with Bluetooth or Near Field Communication, or a single (or array of), fixed antenna(s) connected to a central transceiver. In all cases, the signal attenuation caused by the VIP insulation is the main impediment to reliable communication over a reasonable distance between the wireless communication device 250 and the wireless reader 260. Using the linked antenna pair 200 of the present disclosure, this impediment can be largely circumvented.

To conserve battery life and to meet regulatory requirements, many wireless communication devices 250 operate in a passive mode in that they do not transmit until they receive a wake-up signal from a reader. In many cases, a user will need to "sweep" a number shipping boxes with the wireless reader 260 and hope to get a response back from the wireless communication device 250 in each and every box. Establishing a wake-up condition for the wireless communication device 250 and establishing initial communication are also facilitated by stronger signal transmission enabled by the use of the linked antenna pair 200.

Communication between the wireless communication device 250 and the wireless reader 260 can be improved by the linked antenna pair 200 in several ways including: initial recognition and connection (distance and reliability in establishing a connection between the wireless reader and the wireless communication device), read range (distance that the wireless communication device can reliably communicate with the wireless reader), and speed of data download (speed that could otherwise be degraded by weak or inconsistent signals and require data to be repeatedly resent due to errors).

The invention has been described in detail with particular reference to certain preferred embodiments thereof, but it will be understood that variations and modifications can be effected within the spirit and scope of the invention. The description should not be construed as limiting the scope of the disclosure.

What is claimed is:

1. A shipping container comprising:

a thermally insulated and electromagnetically shielded cavity for holding a payload;

an insulating body comprising a plurality of vacuum insulation panels assembled together;

an insulating cover comprising a vacuum insulation panel that is removably assembled onto the insulating body to define the cavity, wherein each of the vacuum insulation panels in the insulating body and the insulating cover includes an evacuated porous core and a low permeability gas-barrier metallized film; and a linked antenna pair comprising:

a first antenna disposed inside the cavity;

a second antenna disposed outside the cavity; and a feed line electrically connecting the first antenna to the second antenna.

2. The shipping container of claim 1, wherein the feed line passes through a seam between two adjacent vacuum insulation panels.

3. The shipping container of claim 1, wherein the first antenna is affixed to an inner face of a first vacuum insulation panel.

4. The shipping container of claim 3, wherein the second antenna is affixed to an outer face of the first vacuum insulation panel.

5. The shipping container of claim 3, wherein the second antenna is affixed to an outer face of a second vacuum insulation panel adjacent to the first vacuum insulation panel.

6. The shipping container of claim 1, further comprising a radiation absorbing material disposed at or near the members defining the cavity.

7. The shipping container of claim 1, further comprising a wireless communication device located within the electromagnetically shielded cavity.

8. The shipping container of claim 7 further comprising a sensor inside the cavity associated with the wireless communication device.

9. The shipping container of claim 7, wherein the first antenna and the wireless communication device are disposed in predetermined locations within the cavity.

10. The shipping container of claim 9, wherein a pair of opposing sides of the cavity is separated by a first distance and the first antenna and the wireless communication device are separated by a second distance, is the second distance being less than half of the first distance.

11. A shipping container comprising:

a thermally insulated and electromagnetically shielded cavity for holding a payload; and a flexible printed wiring member, comprising a linked antenna pair, the linked antenna pair comprising:

a first antenna disposed inside the cavity;

a second antenna disposed outside the cavity; and a feed line electrically connecting the first antenna to the second antenna;

a first metal layer, the first metal layer forming the feed line, a portion of the first antenna, and a portion of the second antenna;

a second metal layer;

a first dielectric layer disposed between the first metal layer and the second metal layer;

a third metal layer; and a second dielectric layer disposed between the first metal layer and the third metal layer.

12. A shipping container comprising:

a thermally insulated and electromagnetically shielded cavity for holding a payload; and a flexible printed wiring member, comprising a linked antenna pair, the linked antenna pair comprising:

a first antenna disposed inside the cavity, the first antenna being associated with a first ground plane;

a second antenna disposed outside the cavity, the second antenna being associated with a second ground plane; and a feed line electrically connecting the first antenna to the second antenna, the feed line being associated with a third ground plane.

13. The shipping container of claim 12, wherein the first ground plane, the second ground plane and the third ground plane are formed in a single metal layer.

14. A shipping container comprising:

a thermally insulated and electromagnetically shielded cavity for holding a payload; and a flexible printed wiring member, comprising:

a linked antenna pair, the linked antenna pair comprising:

a first antenna disposed inside the cavity;

a second antenna disposed outside the cavity;

a feed line electrically connecting the first antenna to the second antenna;

a first dielectric having a first height disposed between a first signal layer and a first ground plane associated with the first antenna;

a second dielectric having a second height disposed between a second signal layer and a second ground plane associated with the second antenna; and a third dielectric having a third height disposed between a third signal layer and a third ground plane associated with the feed line, wherein the third height is less than both the first height and the second height.

15. A shipping container comprising:

a thermally insulated and electromagnetically shielded cavity for holding a payload;

an insulating body comprising a plurality of vacuum insulation panels assembled together;

an insulating cover comprising a vacuum insulation panel that is removably assembled onto the insulating body to define the cavity, wherein each of the vacuum insulation panels in the insulating body and the insulating cover includes an evacuated porous core and a low permeability gas-barrier metallized film; and a flexible printed wiring member, comprising:

a linked antenna pair, the linked antenna pair comprising:

a first antenna disposed inside the cavity;

a second antenna disposed outside the cavity; and a feed line electrically connecting the first antenna to the second antenna;

a first metal layer, the first metal layer forming the feed line, a portion of the first antenna, and a portion of the second antenna;

a second metal layer, the second metal layer being discontinuous; and a first dielectric layer disposed between the first metal layer and the second metal layer.

* * * * *